United States Patent [19]

Elliott

[11] Patent Number: 4,514,137

[45] Date of Patent: Apr. 30, 1985

[54] METHOD FOR DRIVING TWO-PHASE TURBINES WITH ENHANCED EFFICIENCY

[75] Inventor: David G. Elliott, La Canada, Calif.

[73] Assignee: The United States of America as represented by the Administrator of the National Aeronautics and Space Administration, Washington, D.C.

[21] Appl. No.: 431,420

[22] Filed: Sep. 30, 1982

Related U.S. Application Data

[63] Continuation of Ser. No. 161,257, Jun. 20, 1980, abandoned.

[51] Int. Cl.[3] ..... F01D 1/04

[52] U.S. Cl. ..... 415/1; 415/68

[58] Field of Search ..... 415/1, 30, 60, 66, 67, 415/68, 50

[56] References Cited

U.S. PATENT DOCUMENTS

| | | | |
|---|---|---|---|
| 2,438,357 | 3/1948 | Bloomberg | 415/68 |
| 3,305,214 | 2/1967 | Kennedy | 415/68 X |
| 3,635,576 | 1/1972 | Wieckmann | 415/68 X |

FOREIGN PATENT DOCUMENTS

| | | | |
|---|---|---|---|
| 560584 | 10/1932 | Fed. Rep. of Germany | 415/68 |

*Primary Examiner*—Everette A. Powell, Jr.

*Attorney, Agent, or Firm*—Paul F. McCaul; John R. Manning; Thomas H. Jones

[57] ABSTRACT

A method for driving a two-phase turbine 10 characterized by an output shaft 20 having at least one stage including a bladed rotor connected in driving relation with the shaft, and wherein a two-phase fluid is introduced into said one stage at a known flow velocity and caused to pass through the rotor for imparting angular velocity thereto, the speed of the rotor being controlled so that the angular velocity of the tips of the blades thereof is a velocity equal to at least 50% of the velocity of the flow of the two-phase fluid.

3 Claims, 4 Drawing Figures

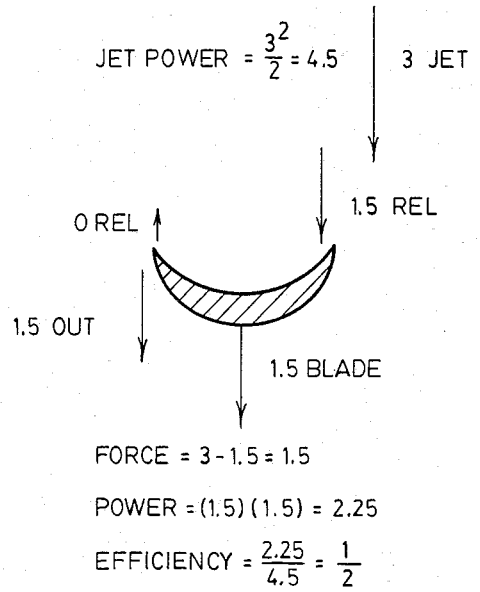
FIG. 2(a) (a) SINGLE-STAGE TURBINE
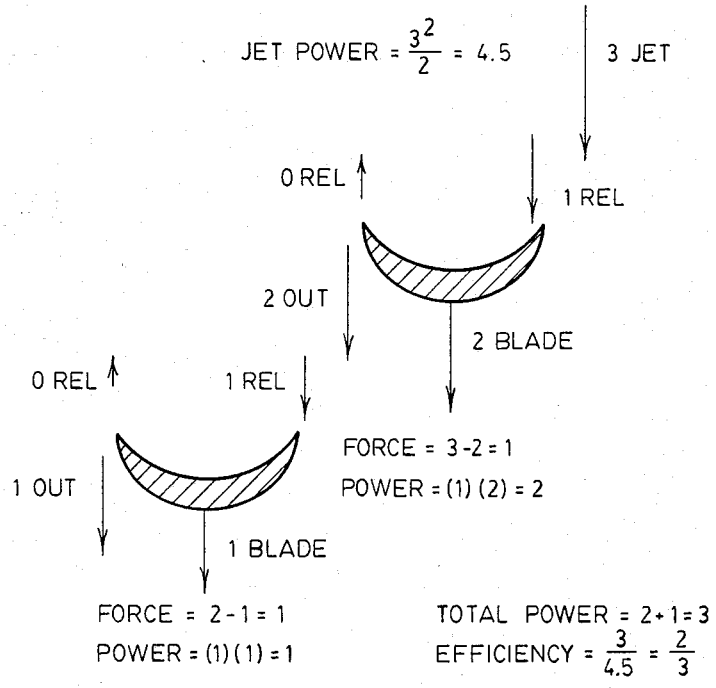
FIG. 2(b) (b) TWO-STAGE TURBINE

METHOD FOR DRIVING TWO-PHASE TURBINES WITH ENHANCED EFFICIENCY

ORIGIN OF THE INVENTION

The invention described herein was made in the performance of work under a NASA Contract and is subject to the provisions of Section 305 of the National Aeronautics & Space Act of 1958. Public Law 85-568 (72 STAT 435; 42 U.S.C. 2457).

This is a continuation of application Ser. No. 161,257, filed June 20, 1980, now abandoned.

BACKGROUND OF THE INVENTION

The invention generally relates to a method for driving two-phase turbines and more particularly to a method for reducing friction loss and low efficiency for multi-stage turbines adapted to be driven by a flow of a liquid-gas mixture, herein referred to as a two-phase fluid.

DESCRIPTION OF THE PRIOR ART

Heretofore, it has been common practice to drive turbines employing a liquid, such as water, or a gas, such as steam, herein simply referred to as a single-phase fluid. In systems designed to utilize steam and the like, multi-staging of turbines is relied upon to permit the angular velocity or tip speed of the turbine blades to be low, when compared to the incoming flow speed or velocity of the single-phase fluid. Such staging frequently is referred to as "Curtis" staging. In these systems, increased fluid friction acting on the blades is considered to be an acceptable price to pay, particularly since fluid friction generally is not considered to constitute a serious impairment to efficiency. Furthermore, the velocity of the tips of the turbine blades, when compared to the linear velocity of the flow of the fluid, must be low in order to maintain the mechanical integrity of the turbine.

In systems designed to utilize a liquid, such as water, fluid friction generally is not considered to constitute a serious impairment to efficiency because of the laminar flow characteristics of the boundary layer established by the liquid as it is caused to flow over the surfaces of the blades of the turbines.

As is well known by those familiar with two-phase fluids, however, where the quantity of the liquid in a flow of two-phase fluids is relatively low, when compared to the total for the two-phase flow, the liquid tends to attach itself to the surfaces of the blades so that the relative velocity thus established between the two-phase liquid and the turbine blades is reduced due to the dissipating effects of the friction. Of course, as the quantity of the flow of liquid is increased, the relative velocities of the flow increases, relative to the velocity of the turbine blades, due to the laminar flow established as the liquid passes over the surfaces of the blades.

Heretofore, even though the angular velocity of the tips of the turbine blade in a two-phase system has been deemed to be acceptably low, due to the effect of friction of the liquid passing over the blades, widespread use of such systems has not been experienced because, at least in part, it commonly has been accepted that suitably high efficiency for turbines designed to be driven by two-phase fluids simply was not obtainable.

It is therefore the general purpose of the instant invention to provide a method through which a turbine may be driven using a two-phase fluid with the efficiency thereof being enhanced through a reduction in friction drag.

OBJECTS AND SUMMARY OF THE INVENTION

It is an object of the instant invention to provide a method through which the efficiency of two-phase turbines is enhanced.

Another object is to provide in a method for driving a two-phase turbine the step of maintaining the angular velocity of the rotor thereof in a value such that the angular velocity of the tips of the rotor blades is a velocity equal to at least 50% of the velocity of a flow of two-phase fluid as the fluid is introduced into the turbine.

These and other objects and advantages are achieved through a method wherein the angular velocity of the rotor is maintained at a value such that the angular velocity of the tips of the blades of the rotor is a velocity equal to at least 50% of the velocity of the flow of a two-phase fluid as the flow is introduced into the turbine, the velocity of the rotor being controlled through the output shaft of the turbine.

DESCRIPTION OF THE DRAWINGS

FIGS. 2*a* and 2*b* comprise diagrammatic views depicting computation of efficiency for two-phase turbines where the relative velocity of the fluid and the blades of the turbine is zero.

DESCRIPTION OF THE PREFERRED EMBODIMENT

Figure 1:
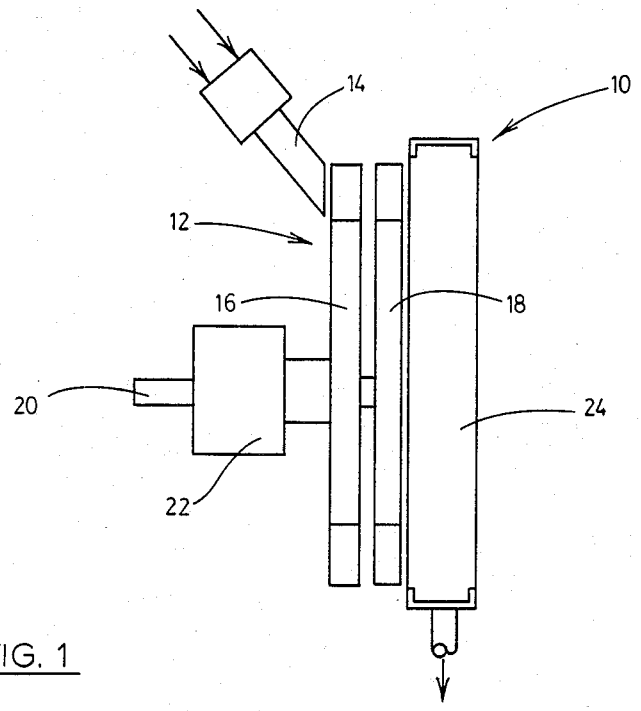
FIG. 1 is a schematic view of a two-stage, two-phase turbine adapted to be driven employing the method embodying the principles of the instant invention.

Referring now to the drawings, with more particularity, there is shown in FIG. 1 a two-stage, two-phase turbine system generally designated 10. Since the structural details of the turbine system 10 forms no part of the claimed invention, a detailed description thereof is omitted in the interest of brevity.

The system 10, as illustrated, however, includes a two-stage, two-phase turbine generally designated 12 connected with a suitable source of two-phase fluid, not shown, via a two-phase nozzle 14. A typical two-phase fluid comprises a water/air mixture ratio of 10:1 by mass.

The turbine 12 includes a first stage, not designated, having a turbine rotor 16, as well as a second stage having a turbine rotor 18. The rotors 16 and 18 are of a bladed design and are connected with a turbine output shaft 20, via a suitable gear box 22. In practice, the gear box 22 serves to connect the rotors 16 and 18 to the output shaft 20 in a manner such that the ratio of the angular velocities of the rotors 16 and 18 is maintained at a constant ratio of 2:1. As is also illustrated in FIG. 1, the turbine system 10 includes a suitable gas-liquid discharge manifold, the function of which should be apparent. It is believed sufficient to note that the rotors 16 and 18 comprise bladed rotors through which is caused to flow a two-phase fluid, injected into the nozzle 14, and that this fluid eventually exits the system via the manifold 24.

It is important to note, however, that the load applied to the shaft 20 is calculated and applied in a manner such that the angular velocity or speed of the rotor 16 is such that the tips of the blades achieve a tangential velocity of at least 50% of the linear velocity of the flow of the two-phase fluid as it exits the nozzle 14. It is known in the prior art to control the velocity of rotor blades through the application of a load applied to an output shaft. A common example is a turbine connected to an electric generator wherein the generator must be synchronized with the electrical power grid to which its power lines are connected. Thus, the actual speed of the turbine blades will be dictated by the synchronization of the electric generator. Since the ratio of the angular velocities for the rotors 16 and 18 is 2:1, it should be apparent to those familiar with tip speeds of rotors of turbines designed for two-phase fluid systems that the tip speed or angular velocity for the tips of the rotors 16 and 18 is "high" relative to the linear velocity of the incoming flow of two-phase fluid.

Referring for a moment to FIG. 2*a*, therein is illustrated computation for a "worst-case" condition for the system shown in FIG. 1. In this condition, it is assumed that the relative velocity of the two-phase fluid as it passes over the turbine blades is zero. In other words, as illustrated, the two-phase fluid enters the first stage of the system 10 at a velocity of three, any unit, designated 3 JET, while the velocity of the tips of the blades of the rotor 16 is 1.5, designated 1.5 BLADE. Thus the fluid enters the turbine at a speed of 1.5, relative to the blade, designated 1.5 REL. However, because of frictionally induced velocity losses, the fluid exits the rotor at an absolute exit velocity of 1.5, 1.5 OUT, so that the relative velocity of the fluid flow and the tips of the turbine blades is equal to zero, 0 REL.

The kinetic energy of the jet, or jet power, is one-half the jet velocity squared, JET POWER $=3^2/2=4.5$. The force of the flow exerted on the blade is equal to momentum change, FORCE $=3-1.5=1.5$; the power output is equal to the force of the flow multiplied by the velocity of the blade, POWER $=(1.5)(1.5)=2.25$; and the efficiency of the turbine is equal to the output power divided by the kinetic energy of the jet, EFFICIENCY $=2.25/4.5=\frac{1}{2}$, or 50%.

Using known computational methods, it can be calculated that the efficiency of the system 10 is equal to the ratio of $N/N+1$, where N equals the number of stages in the turbine.

In order to calculate the efficiency for the two-stage, two-phase turbine, depicted in FIG. 1, it is noted that the power out for each stage, FIG. 2*b*, is determined with the output power for both stages being computed and then totaled and divided by the kinetic energy of the velocity as it is introduced to the question. For example, note that for the first stage, FORCE $=3-2=1$, and POWER $=(1)\times(2)=2$, while the FORCE (of the second stage) $=2-1=1$ and POWER $=(1)\times(1)=1$. The TOTAL POWER (for the two-stage system) $=2+1=3$, and EFFICIENCY $=3/4.5=\frac{2}{3}$ or 66.6%.

Figure 3:
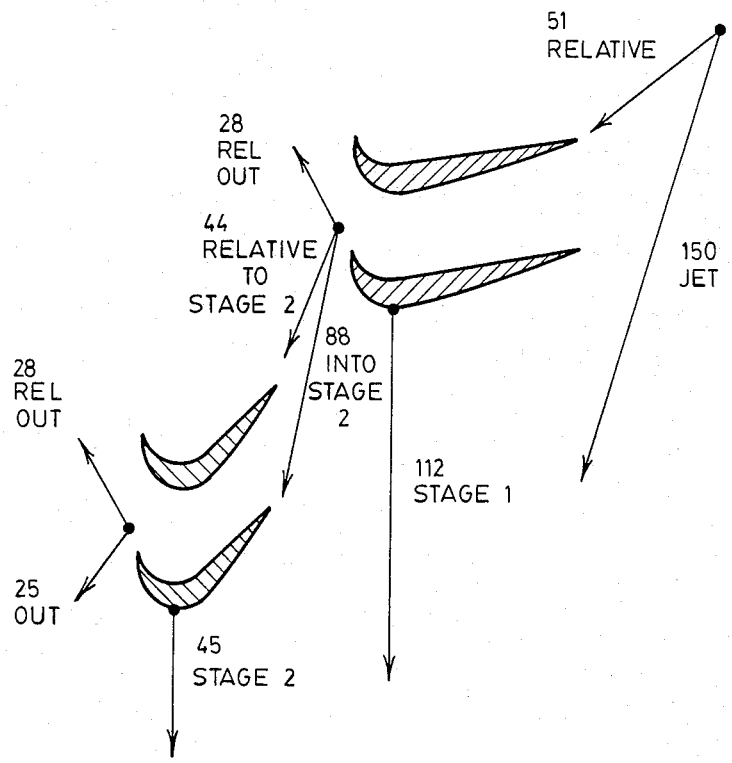
FIG. 3 is a diagrammatic view depicting computation of efficiency for a two-stage, two-phase turbine wherein the velocity of the exiting fluid flow relative to the velocity of the turbine blades is greater than zero.

At most practical flow conditions, the liquid velocity loss is not as great as depicted in FIGS. 2*a* and 2*b*, and higher efficiencies are in fact realized. As indicated in FIG. 3, where the angles of the flow of two-phase fluids are ignored and it is assumed that the two-phase fluid possesses a velocity relative to the velocity of the tips of the blades of each stage, a higher efficiency can be expected. For example, for the first stage, as depicted in FIG. 3, JET POWER $=(0.5)(150^2)=11{,}250$; FORCE $=150-88=62$; POWER $=(62)(112)=6944$. The output power for the second stage is computed as follows: FORCE $=88-25=63$; POWER $=63\times45=2835$. Hence, TOTAL POWER $=6944+2835=9779$.

By dividing the total power, or 9779 by the kinetic energy, or jet power 11250, an efficiency of 87% is computed.

In view of the foregoing, it is believed to be readily apparent that the present invention provides a solution to the problem of large friction loss and low efficiency, previously encountered, utilizing two-phase flow in turbines.

What is claimed is:

1. An improved method of driving a two-phase fluid turbine having at least a first and second stage of bladed rotors sequentially receiving the two-phase fluid to extract kinetic energy for driving an output shaft through a gear box connecting the respective rotors and the output shaft, comprising the steps of:

(a) introducing into the first stage bladed rotor, at a predetermined linear flow velocity, a flow of the two-phase fluid;

(b) causing the two-phase fluid to pass through the first and second stages so that the stages rotate in the same direction;

(c) maintaining the tangential velocity of the first stage bladed rotor tips at a velocity greater than fifty percent of the predetermined linear flow velocity entering the first stage;

(d) maintaining the tangential velocity of the second stage rotor blade tips at a fixed ratio of about fifty percent of the tangential velocity of the first stage bladed rotor; and (d) exhausting the two-phase fluid from the second stage whereby a power efficiency of at least two-thirds is extracted from the kinetic energy of the two-phase fluid introduced into the first stage.

2. A method as defined in claim 1 wherein the tangential velocity of the first stage rotor is about two-thirds of the predetermined linear flow velocity entering the first stage.

3. An improved method of driving a two-phase fluid turbine having at least a first and second stage, said bladed rotors being generally parallel to each other, of bladed rotors sequentially receiving the two-phase fluid to extract kinetic energy for driving an output shaft through a gear box connecting the respective rotors and the output shaft, the load applicable to the output shaft controlling the rotor velocity comprising the steps of:

(a) introducing into the first stage bladed rotor, at a predetermined linear flow velocity, a flow of the two-phase fluid;

(b) causing the two-phase fluid to pass through the first and second stages so that the stages rotate in the same direction;

(c) maintaining the tangential velocity of the first stage bladed rotor tips at a velocity greater than fifty percent of the predetermined linear flow velocity entering the first stage;

(d) maintaining the tangential velocity of the second stage rotor blade tips at a fixed ratio of about fifty percent of the tangential velocity of the first stage bladed rotor tips; and (e) exhausting the two-phase fluid from the second stage whereby a power efficiency of greater than two-thirds is extracted from the kinetic energy of the two-phase fluid introduced into the first stage.

* * * * *